US007576644B2

(12) United States Patent
Hart

(10) Patent No.: US 7,576,644 B2
(45) Date of Patent: Aug. 18, 2009

(54) METHOD AND APPARATUS FOR PROVIDING LOCATION-SPECIFIC INFORMATION THROUGH A MOBILE DEVICE

(75) Inventor: Matt E. Hart, Lunenberg, MA (US)

(73) Assignee: Intuit Inc., Mountain View, CA (US)

( * ) Notice: Subject to any disclaimer, the term of this patent is extended or adjusted under 35 U.S.C. 154(b) by 223 days.

(21) Appl. No.: 11/481,738

(22) Filed: Jul. 5, 2006

(65) Prior Publication Data

US 2008/0007399 A1 Jan. 10, 2008

(51) Int. Cl.
*G08B 1/08* (2006.01)

(52) U.S. Cl. ..... 340/539.11; 340/539.1; 340/539.13; 340/825.36; 340/825.49; 369/70

(58) Field of Classification Search ..... 340/539.11, 340/539.1, 539.13, 825.36, 825.49; 369/70; 455/18, 67.11, 67.12, 67.13
See application file for complete search history.

(56) References Cited

U.S. PATENT DOCUMENTS 6,169,498 B1 * 1/2001 King et al. ..... 340/686.1
7,084,758 B1 * 8/2006 Cole ..... 340/539.11

* cited by examiner

*Primary Examiner*—Daryl Pope
(74) *Attorney, Agent, or Firm*—Park, Vaughan & Fleming LLP

(57) ABSTRACT

A system that provides location-specific information through a mobile device. During operation, the system receives coordinates for a physical location of the mobile device from a global-positioning system (GPS) receiver within the mobile device. The system then retrieves a description of a point of interest within a specified range of the coordinates received for the physical location and presents the description of the point of interest to a user through the mobile device.

23 Claims, 2 Drawing Sheets

METHOD AND APPARATUS FOR PROVIDING LOCATION-SPECIFIC INFORMATION THROUGH A MOBILE DEVICE

BACKGROUND

Related Art

Recent breakthroughs in semiconductor manufacturing technologies have made it possible to develop complex, high-performance ICs that consume very little power. These technological advances have led to the development of a number of highly innovative mobile devices at price points which would have been unimaginable just a few years ago.

In particular, handheld navigation systems based on the Global Positioning System (GPS) have become very popular. These handheld devices typically use the device's present location to determine a route to a destination based on information about roads leading to the destination. Some of these systems require the user to specify the street address of the destination. However, users often don't know the street addresses of popular destinations, e.g., museums, airports, etc. To overcome this problem, some GPS-based navigation systems store a list of points-of-interests which can be used in lieu of entering a specific street address. For example, if a user wants to visit Mount Rushmore, but does not know the address of Mount Rushmore, the user can select Mount Rushmore from a points-of-interest list. The GPS-based navigation system can then look-up the address for the point-of-interest and determine a route from the present physical location to the destination address.

GPS-based devices can also be used to provide coordinates of the device's current location. For example, a wristwatch with a GPS receiver can display the current GPS coordinates of the wristwatch. Further, GPS-based devices can be used to record a path taken by the GPS-based device and to play back the path at a later time. For example, a GPS-based device can be used to record the path taken by a bicyclist and replay the information at a later time.

Unfortunately, existing GPS-based devices do not provide any information about a point-of-interest, other than possibly displaying an icon on the screen as the user passes by the point-of-interest.

SUMMARY

One embodiment of the present invention provides a system that provides location-specific information through a mobile device. During operation, the system receives coordinates for the mobile device's physical location using a global-positioning system (GPS) receiver. The system then retrieves a description of a point-of-interest which is located within a specified range of the mobile device's coordinates, and presents the description to a user through the mobile device.

In a variation on this embodiment, the description is presented to the user as an audio description.

In a variation on this embodiment, the description is presented to the user as a visual description.

In a variation on this embodiment, the description is retrieved from a remote storage.

In a variation on this embodiment, the description is retrieved from a local storage within the mobile device.

In a further variation, the description in the local storage within the mobile device is updated on a periodic basis.

In a further variation, the description is updated through a wireless network.

In a further variation, the description is updated through a wired connection.

In a variation on this embodiment, the description is created by the user. The user-created description is then stored on a local storage within the mobile device.

In a variation on this embodiment, the description is created by the user or another user, and the user-created description is then shared with other mobile-device users.

DETAILED DESCRIPTION

The following description is presented to enable any person skilled in the art to make and use the invention, and is provided in the context of a particular application and its requirements. Various modifications to the disclosed embodiments will be readily apparent to those skilled in the art, and the general principles defined herein may be applied to other embodiments and applications without departing from the spirit and scope of the present invention. Thus, the present invention is not limited to the embodiments shown, but is to be accorded the widest scope consistent with the principles and features disclosed herein.

The data structures and code described in this detailed description are typically stored on a computer-readable storage medium, which may be any device or medium that can store code and/or data for use by a computer system. This includes, but is not limited to, magnetic and optical storage devices such as disk drives, magnetic tape, CDs (compact discs) and DVDs (digital versatile discs or digital video discs), or any device capable of storing data usable by a computer system.

One embodiment of the present invention provides geographic and/or location-specific information through a mobile device.

Figure 1:
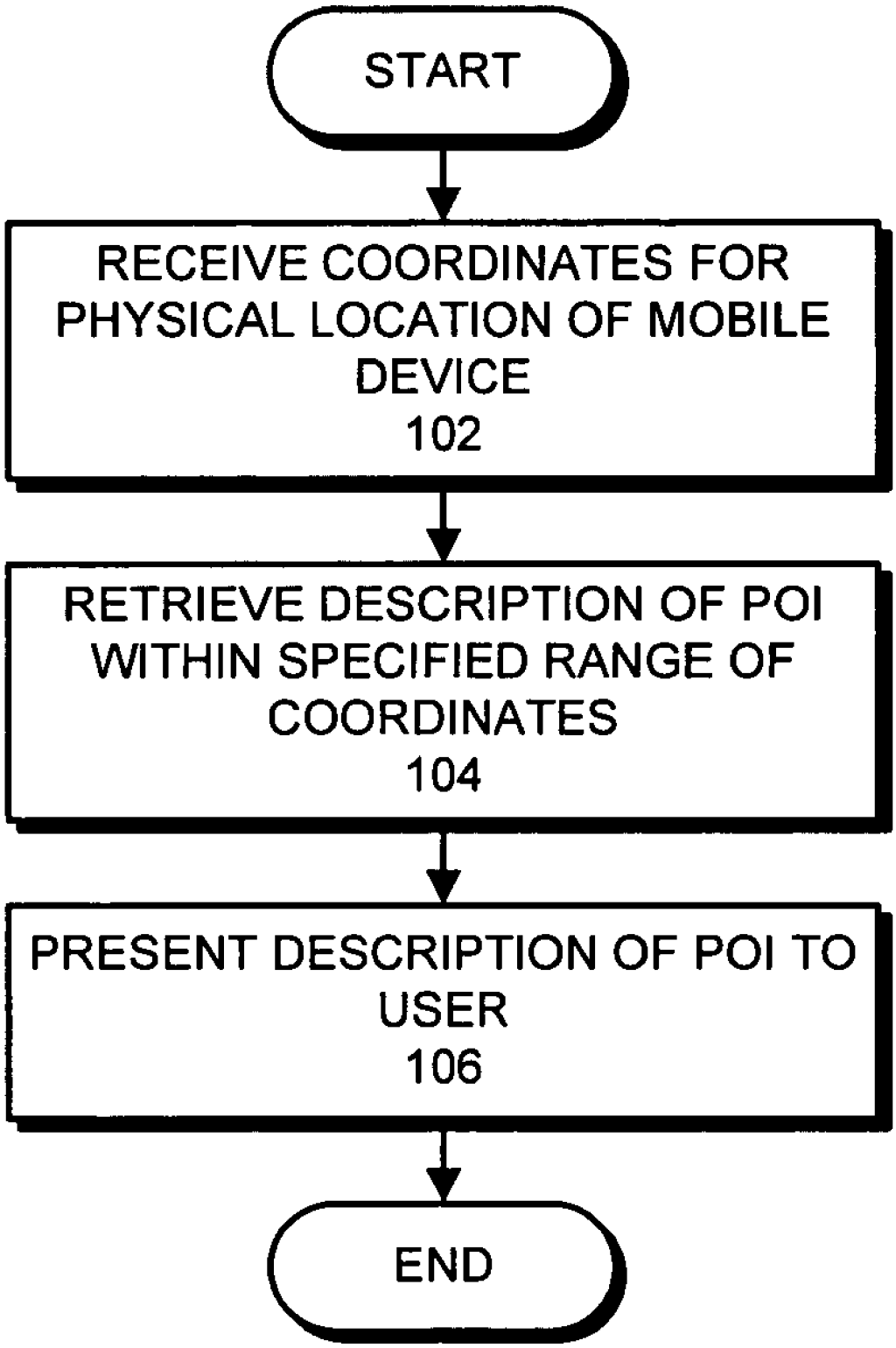
FIG. 1 presents a flow chart illustrating the process of providing geographic information on a mobile device in accordance with an embodiment of the present invention.

FIG. 1 presents a flow chart illustrating the process of providing geographic and/or location-specific information on a mobile device in accordance with an embodiment of the present invention.

The process begins when the system receives coordinates for a physical location of the mobile device from a global-positioning system (GPS) receiver within the mobile device (step 102). Note that the coordinates can be manually entered into the mobile device or can be retrieved from a database of points-of-interest stored on the mobile device or on a server on the Internet. Next, the system retrieves a description of a point-of-interest within a specified range of the coordinates received for the physical location (step 104). In one embodiment of the present invention, the system retrieves the description of the point-of-interest based on a user preference. For example, if a user is interested in historical aspects of points-of-interests, the system retrieves descriptions of the history of the point-of-interest. The system then presents the description of the point-of-interest to a user through the mobile device (step 106). In one embodiment of the present invention, the description is presented to the user as an audio description. In another embodiment of the present invention, the description is presented to the user as a visual description.

Figure 2:
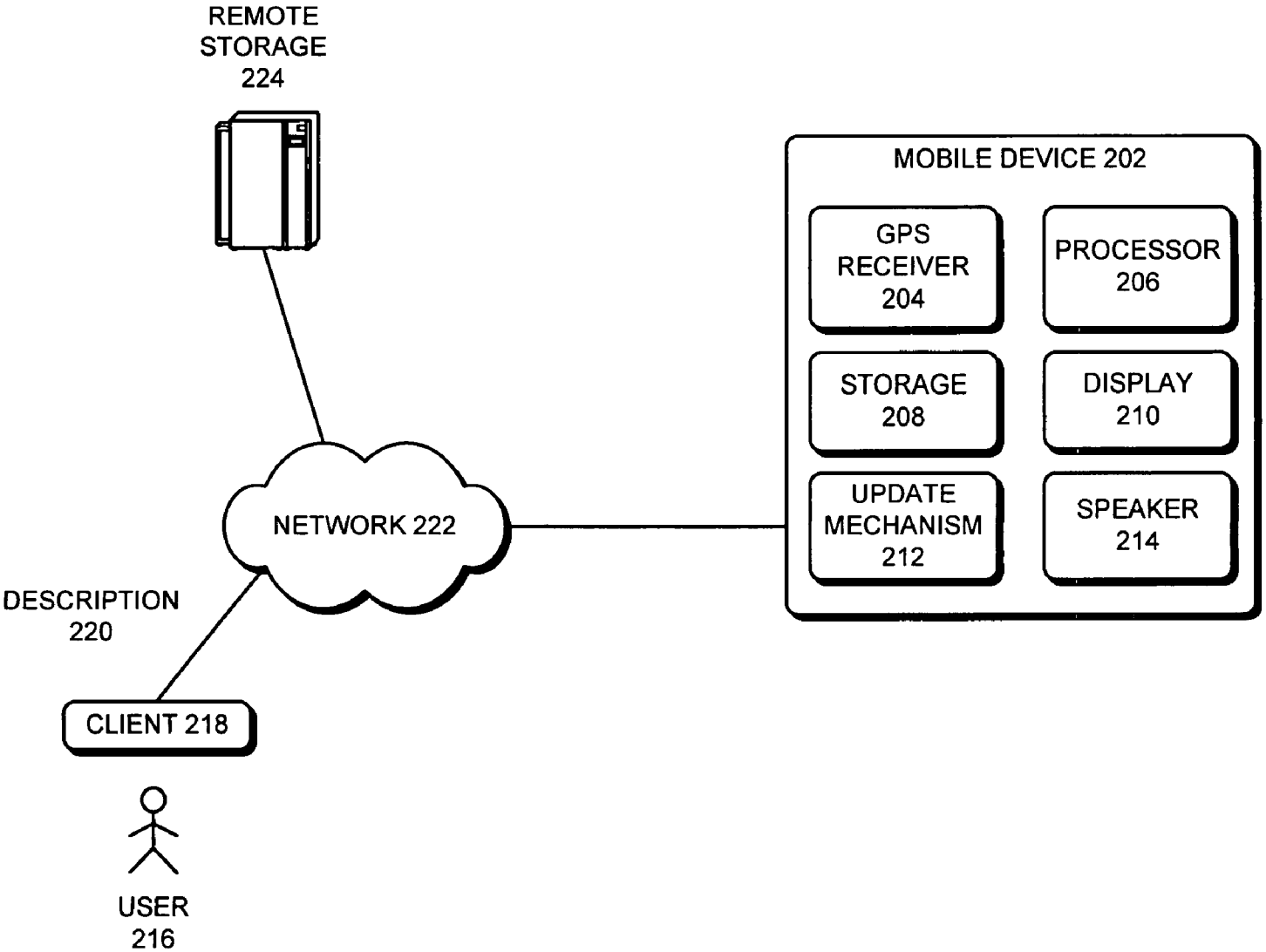
FIG. 2 presents a block diagram of a mobile device in accordance with an embodiment of the present invention.

FIG. 2 presents a block diagram of mobile device 202 in accordance with an embodiment of the present invention.

Mobile device 202 includes GPS receiver 204, processor 206, storage 208, display 210, update mechanism 212, and speaker 214.

In one embodiment of the present invention, GPS receiver 204 determines the coordinates for a physical location of the mobile device based on signals received from a network of satellites in orbit. Note that GPS receiver 204 can include any receiver which can receive signals from a network of devices in order to pinpoint a physical location of the mobile device. Also note that the network of devices can be a network of land-based devices or a network of space-based devices in orbit. For example, the receiver can be an assisted GPS (A-GPS) receiver, which determines a location by passing GPS signals to a cell phone tower for processing. A plurality of cellular phone towers can also triangulate a cellular phone signal emitted from a cellular phone. Similarly, active radio frequency identification (RFID) receivers can be placed proximate to a point-of-interest. When a mobile device is within a specified range of the point-of-interest, the location of the mobile device can be determined.

In one embodiment of the present invention, processor 206 uses information about the coordinates for the physical location of mobile device 202 to retrieve a description of a point-of-interest within a specified range of the mobile device from storage 208. In one embodiment of the present invention, processor 206 displays a visual description of a point-of-interest on display 210. In another embodiment of the present invention, processor 206 plays an audio version of a description of a point-of-interest through speaker 214. In another embodiment of the present invention, processor 206 sends the description to a printer (not shown) coupled to mobile device 202.

In one embodiment of the present invention, the description is an audio description played to a user through a cell phone. In this embodiment, the user dials into a server and enters the present coordinates. The server then plays back an audio description of the point-of-interest for the coordinates. In one embodiment of the present invention, the cell phone is coupled to the mobile device so that the present coordinates are transmitted from the mobile device to the cell phone without requiring the user to manually enter in the present coordinates.

Processor 206 can generally include any type of processor, including, but not limited to, a microprocessor, a digital signal processor, a device controller, or a computational engine within an appliance.

Storage 208 can include any type of non-volatile storage device that can be coupled to mobile device 202. This includes, but is not limited to, magnetic, optical, and magneto-optical storage devices, as well as storage devices based on flash memory and/or battery-backed up memory.

In one embodiment of the present invention, a description of a point-of-interest is retrieved from storage within the mobile device. In this embodiment, the description in storage within the mobile device is updated on a periodic basis. In one embodiment of the present invention, the description is updated through a wireless network. In another embodiment of the present invention, the description is updated through a wired connection.

In one embodiment of the present invention, user 216 creates description 220 for a point-of-interest. User 216 uses client 218 to upload description 220 to mobile device 202 through network 222. Update mechanism 212 receives description 220 and updates storage 208 with description 220 for the point-of-interest. In one embodiment of the present invention, update mechanism 212 associates description 220 with a point-of-interest already stored in storage 208. In another embodiment of the present invention, update mechanism 212 creates a new entry in storage 208 for a new point-of-interest and associates description 220 with the new entry.

In another embodiment, a description of a point-of-interest can be stored at remote storage 224. Remote storage 224 can be any node that is capable of storing data. For example, remote storage 224 can be a database, a file server, a web server, or an application server.

User 216 can use client 218 to upload description 220 to remote storage 224 using network 222. Subsequently, mobile device 202 can download description 220 from the remote storage 224 using network 222.

Network 222 can generally include any type of wired or wireless communication channel capable of coupling together computing nodes. This includes, but is not limited to, a local area network, a wide area network, or a combination of networks. In one embodiment of the present invention, network 222 comprises the Internet. Note that client 218 may be coupled to network 222 through another network. For example, client 218 can be coupled to network 222 through a cellular phone network.

In one embodiment of the present invention, description 220 is sent to mobile device 202 through a wireless network, which includes, but is not limited to: a cellular phone network, a Bluetooth network, and a wireless local area network (WLAN).

In one embodiment of the present invention, description 220 is sent to mobile device 202 through a wired network, which includes, but is not limited to, an Ethernet local area network (LAN).

In one embodiment of the present invention, description 220 is sent to mobile device 202 through a direct cable connection which includes, but is not limited to: an IEEE 1394 (i.e., Firewire) cable connection, a Universal Serial Bus (USB) cable connection, a serial cable connection, and a parallel-port cable connection.

In one embodiment of the present invention, description 220 is created on mobile device 202. For example, user 216 can use a microphone (not shown) and keypad (not shown) coupled with mobile device 202 to create description 220 for a point-of-interest. Note that client 218 can be a mobile device which is similar to mobile device 202.

In one embodiment of the present invention, user 216 creates description 220 for a point-of-interest by making a call to a server using a cellular phone and causing mobile device 202 to store the present coordinates and the present time. The server records an audio description of the point-of-interest from the user through the cellular phone and notes the time when the user recorded the description. At a later time, the user synchronizes the mobile device with the server. Mobile device 202 uses the timestamp generated by both mobile device 202 and the server to retrieve the description of the point-of-interest stored on the server. Mobile device 202 then associates the coordinates for the point-of-interest, which is indexed by the timestamp on mobile device 202, with the description retrieved from the server to create the description of the point-of-interest on mobile device 202.

In one embodiment of the present invention, a description of a point-of-interest is composed of a series of descriptions which depends on the route taken by the user. In this embodiment, the description is displayed at various coordinates along the route. For example, when traveling on a given route, the descriptions of the points-of-interest that are visible on that route traveling in one direction can be different than the descriptions of the points-of-interest on the same route traveling in the other direction. Consider the case when a user is entering San Francisco by way of the Golden Gate Bridge. By taking the Golden Gate Bridge into San Francisco, the user can see the San Francisco Marina as well as Fort Point and Crissy Field. When the user is exiting San Francisco by way of the Golden Gate Bridge, the user can see the Marin Headlands as well as Angel Island. Although the GPS coordinates are the same (i.e., the coordinates for the Golden Gate Bridge), the direction of travel across the bridge determines what a user can see.

In one embodiment of the present invention, user 216 creates a description of a point-of-interest and shares the description with other mobile-device users. Specifically, user 216 can create a description while he or she is visiting a point-of-interest. For example, user 216 can create a description which can comprise a commentary which was created when user 216 visited the point-of-interest. Further, the description can also comprise an audiovisual recording of user 216's visit to the point-of-interest. User 216 can store the description on remote storage 224, which can then be presented to other users who are either at the point-of-interest or who are passing by the point-of-interest. Alternatively, before embarking on a journey, a user can download descriptions of a number of points-of-interests from remote storage 224 and store them on local storage 208. During the journey, when the user passes by a point-of-interest, mobile device 202 can use the coordinates of the user's present location to select a description from local storage 208, and then present it to the user.

Note that a number of techniques can be used to determine which points-of-interest descriptions to present to a user. For example, in one embodiment, mobile device 202 can be configured to select a point-of-interest description based on a user's preferences. For example, a user can specify that he or she is interested in historical sites. Mobile device 202 can provide the user with a description of a historical site whenever he or she is in proximity to the historical site.

Alternatively, a user can specify a social network that he or she belongs to, wherein the social network can be composed of individuals who have similar interests. Mobile device 202 can provide a location-specific description to a user whenever he or she is in proximity to a point-of-interest which was highly recommended by another user in the social network.

For example, a first user can specify that he or she is a member of a spelunking club. Next, when the first user is on a spelunking trip, mobile device 202 can provide a description to the first user about a nearby cave which was recently discovered by a second user who also belongs to the spelunking club. Prior art GPS based navigation systems do not have the capability of providing a description of a nearby point-of-interest to a user based on the user's interests. Furthermore, prior art mobile devices do not have the capability of providing up-to-date descriptions about little known points-of-interests that are in proximity to the user's current physical location. Additionally, prior art mobile devices do not have the capability of creating descriptions of points-of-interests which can be shared with other users.

Note that a user may not know exactly where he or she will be traveling. For example, on a spelunking trip, although the user knows that he or she is going to be in a general area, the exact path taken by the user may not be known in advance. In such situations, the present invention can be very useful because it can provide detailed descriptions about nearby points-of-interests based on the user's current location and his or her interests.

In one embodiment, a description of a point-of-interest may be directly communicated from one mobile device to another. For example, a first user may use a first mobile device to create a first description of a point-of-interest, e.g., a cave, and store it in the first mobile device's local storage. Meanwhile, a second mobile device which may be in proximity to the first mobile device can display the first description to a second user by directly receiving the first description from the first mobile device. Alternatively, the first mobile device may communicate with the second mobile device over a network, such as, network 222. In another embodiment, the first mobile device can upload the first description to a remote storage, and the second mobile device can download the description from the remote storage.

The foregoing descriptions of embodiments of the present invention have been presented only for purposes of illustration and description. They are not intended to be exhaustive or to limit the present invention to the forms disclosed. Accordingly, many modifications and variations will be apparent to practitioners skilled in the art. Additionally, the above disclosure is not intended to limit the present invention. The scope of the present invention is defined by the appended claims.

What is claimed is:

1. A method for providing location-specific information through a mobile device to a user, comprising:

receiving coordinates of a mobile device's physical location using a global-positioning system (GPS) receiver;

retrieving a description of a point-of-interest which is located within a specified range of the mobile device's coordinates, wherein the mobile device uses the received coordinates of the physical location to select the description of the point-of-interest; and wherein the description depends on the route taken by the user; and presenting the description to the user through the mobile device.

2. The method of claim 1, wherein the description is presented to the user as an audio description.

3. The method of claim 1, wherein the description is presented to the user as a visual description.

4. The method of claim 1, wherein the description is retrieved from a remote storage.

5. The method of claim 1, wherein the description is retrieved from a local storage within the mobile device.

6. The method of claim 5, wherein the description is updated on a periodic basis.

7. The method of claim 6, wherein the description is updated through a wireless network.

8. The method of claim 6, wherein the description is updated through a wired connection.

9. The method of claim 1, wherein the description is created by a user or another user; and wherein the user-created description is stored on a local storage within the mobile device.

10. The method of claim 1, wherein the description is created by a user or another user; and wherein the user-created description is shared with other mobile-device users.

11. A computer-readable storage medium storing instructions that when executed by a computer cause the computer to perform a method for providing location-specific information through a mobile device to a user, wherein the method comprises:

receiving coordinates of a mobile device's physical location using a global-positioning system (GPS) receiver;

retrieving a description of a point-of-interest which is located within a specified range of the mobile device's coordinates, wherein the mobile device uses the received coordinates of the physical location to select the description of the point-of-interest; and wherein the description depends on the route taken by the user; and presenting the description to the user through the mobile device.

12. The computer-readable storage medium of claim 11, wherein the description is presented to the user as an audio description.

13. The computer-readable storage medium of claim 11, wherein the description is presented to the user as a visual description.

14. The computer-readable storage medium of claim 11, wherein the description is retrieved from a remote storage.

15. The computer-readable storage medium of claim 11, wherein the description is retrieved from a local storage within the mobile device.

16. The computer-readable storage medium of claim 15, wherein the description is updated on a periodic basis.

17. The computer-readable storage medium of claim 16, wherein the description is updated through a wireless network.

18. The computer-readable storage medium of claim 16, wherein the description is updated through a wired connection.

19. The computer-readable storage medium of claim 11, wherein the description is created by a user or another user and wherein the user-created description is stored on a local storage within the mobile device.

20. The computer-readable storage medium of claim 11, wherein the description is created by a user or another user; and wherein the user-created description is shared with other mobile-device users.

21. An apparatus that provides location-specific information to a user, comprising:

a global-positioning system (GPS) receiver configured to receive coordinates of the apparatus's physical location;

a retrieving mechanism configured to retrieve a description of a point-of interest which is located within a specified range of the apparatus's coordinates, wherein the apparatus uses the received coordinates of its physical location to select the description of the point-of-interest; and wherein the description depends on the route taken by the user; and a presenting mechanism configured to present the description to the user.

22. The apparatus of claim 21, wherein the description is created by a user or another user and wherein the user-created description is stored on a local storage within the apparatus.

23. The apparatus of claim 21, wherein the description is created by a user or another user; and wherein the user-created description is shared with other mobile-device users.

* * * * *